US006753754B1

(12) United States Patent
Black et al.

(10) Patent No.: US 6,753,754 B1
(45) Date of Patent: Jun. 22, 2004

(54) VARIABLY FUSABLE POWER DISTRIBUTION BLOCK KIT

(75) Inventors: Van Edward Black, Bedford, TX (US); Scott Andrew Ringo, Euless, TX (US)

(73) Assignee: Dobbs Stanford Corp., Dallas, TX (US)

( * ) Notice: Subject to any disclaimer, the term of this patent is extended or adjusted under 35 U.S.C. 154(b) by 0 days.

(21) Appl. No.: 10/402,740

(22) Filed: Mar. 29, 2003

(51) Int. Cl.[7] ..... H01H 85/22; H01R 13/68; H01R 4/48

(52) U.S. Cl. ..... 337/215; 337/214; 337/187; 361/626; 361/642; 439/250; 439/830

(58) Field of Search ..... 337/187, 186, 337/146, 156, 189, 214–216; 361/626, 642, 646, 837; 439/250, 366, 621, 830, 835, 890, 893

(56) References Cited

U.S. PATENT DOCUMENTS

| | | | | | |
|---|---|---|---|---|---|
| 2,308,596 | A | * | 1/1943 | Drury | 337/187 |
| 3,744,003 | A | | 7/1973 | Dipace | |
| 3,821,695 | A | | 6/1974 | Sholer | |
| 4,097,109 | A | | 6/1978 | Cross | |
| 4,721,862 | A | | 1/1988 | Cooper | |
| 4,846,733 | A | | 7/1989 | Baisz et al. | |
| 5,125,855 | A | | 6/1992 | Brooks | |
| 5,167,541 | A | * | 12/1992 | Alves et al. | 439/622 |
| 5,328,392 | A | * | 7/1994 | Lin et al. | 439/833 |
| 5,346,411 | A | | 9/1994 | Nikkinen | |
| 5,362,253 | A | * | 11/1994 | Lin et al. | 439/462 |
| 5,551,894 | A | * | 9/1996 | Lin et al. | 439/621 |
| 5,562,502 | A | | 10/1996 | Kourimsky | |
| 5,618,209 | A | * | 4/1997 | Lin et al. | 439/621 |
| 5,628,654 | A | | 5/1997 | Lineberry, Jr. | |
| 5,833,497 | A | | 11/1998 | Byfield, Jr. | |
| 6,007,350 | A | | 12/1999 | Isshiki | |
| 6,022,247 | A | | 2/2000 | Akiyama et al. | |
| 6,107,788 | A | | 8/2000 | Oya et al. | |
| 6,162,097 | A | * | 12/2000 | Liang | 439/621 |
| D442,148 | S | * | 5/2001 | Renne et al. | D13/178 |
| 6,309,253 | B1 | | 10/2001 | Tsai | |
| 6,326,878 | B1 | * | 12/2001 | Liang | 337/215 |
| 6,457,995 | B1 | | 10/2002 | Brooks | |
| 6,519,156 | B2 | * | 2/2003 | Scafidi | 361/704 |
| 2002/0123267 | A1 | | 9/2002 | Brooks | |

* cited by examiner

*Primary Examiner*—Anatoly Vortman
(74) *Attorney, Agent, or Firm*—John G. Fischer; Storm & Hemingway LLP

(57) ABSTRACT

A novel power block distribution block kit is disclosed. The blocks may use MAXI or AUG, or other types of commercially available type fuses. The present invention discloses a variably fusable power distribution block kit that permits custom configuration of the fuse to circuit relationships on a common base, and with a common cover to achieve higher circuit ratings with the same device, fuses, and component parts.

5 Claims, 9 Drawing Sheets

VARIABLY FUSABLE POWER DISTRIBUTION BLOCK KIT

CROSS-REFERENCE TO RELATED APPLICATION

None.

BACKGROUND OF THE INVENTION

1. Technical Field

The present invention relates to the technology of electrical connection design and in particular, to the technology of fuse box design and power distribution circuits. More specifically, the present Invention relates to the design of a fuse box kit of the type that would be commonly used in an automobile, boat, plane, RV, or other vehicle, where it would be desirable to variably multiply the available fuse protection for applications involving equipment having high power load requirements.

2. Description of Related Art

Most vehicles have a number of electrical components such as lights, horns, stereo radios, televisions, DVD players, amplifiers, and the like. To protect the electrical circuits of the vehicles, fuses are located in the circuit for each electrical accessory. The fuses are typically positioned in a central fuse box between the electrical supply and the accessory. The main function of the fuse is to protect the wiring circuit. The fuse contains an internal conductor which provides the electrical connection between the ends of the fuse. The conductor inside the fuse is a metallic strip that has a lower melting temperature than the wiring of the circuit. The size of the conductor is calibrated so that when the failure rating of the fuse is reached, sufficient heat will be generated to melt the conductor and break the circuit (burn the fuse). In use, if an accessory fails, the increased power demand in the circuit will exceed the failure rating of the fuse, causing the fuse to bum and separate, breaking the electrical connection. If a fuse is not used, overcurrent conditions could damage circuit elements or the electric accessory, overheat the wiring and perhaps cause a fire. The condition presents a danger to both life and property.

Most automobiles have two fuse panels. The engine compartment fuse panel typically contains the fuses for protection of the electrical circuits associated with the primary vehicle functions such as cooling fans, anti-lock brake pumps, and the engine control units. An interior fuse panel is usually located under the dash on the driver's side of the vehicle, and protects the electrical circuits associated with the electrical devices inside the passenger compartment.

Different fuse designs have different rating ranges. For example, AGU fuses (glass cylinder type) are commercially available with ratings between 5 and 60 amps. MAXI fuses (blade type) are commercially available with ratings between 20 and 80 amps. The more expensive ANL fuses (wafer type) are commercially available with ratings between 60 and 300 amps. For larger loads, circuit breakers are generally required.

Improvements in electronics and microchip technology have led to an enormous increase in the development and availability of high technology accessories for use in vehicles. These devices include CD players, DVD players, televisions, computers, telephones, fax machines, custom lighting, special effects devices, high powered amplifiers, other stereo system components, and other appliances configured to operate at low voltages. The number of options far exceeds the availability, capacity, and design of factory supplied electric circuits.

Frequently, the load requirement of a desired accessory exceeds the highest rated fuse that can fit in a factory supplied fuse panel. For example, many stereo amplifiers are rated at 2,000 or even 3,000 watts. 150 amp fuses are required for these units. As a result, the consumer must either purchase a separate fuse panel for the accessory that accommodates ANL fuses, or install a circuit breaker.

In addition to a lack of space of the factory supplied fuse panels, a variety of electric devices available on the market have significantly different load requirements. As a result, some accessories may require higher current circuits with higher fuse ratings, and other accessories may require lower current circuits with lower fuse ratings. Due to the difference in fuse design capacity, the consumer is required to purchase more than one additional fuse panel.

As a result of the above described issues, retailers will normally stock two or three different power distribution panels to accommodate the different fuse designs, as well as the different sizes of AWG gage input wires.

The large custom automobile market has created a special demand for additional power distribution and high current load capable circuits. These applications require solutions that not only satisfy the electric system functionality requirements, but solutions that are cosmetically enhancing. It is common in the custom automobile industry to use gold plated fuses, and fuse panels with highly decorative architecture.

Numerous devices have been developed for the purpose of providing additional power distribution that are cosmetically attractive. Other devices have been developed which permit fuse stacking to provide a higher fuse rating by using multiple fuses on a circuit.

One such device is disclosed in U.S. Pat. No. 6,457,995 B1 issued to Brooks. The device is a distributor having a positive input terminal block separated by a riser from a negative current input terminal block.

Another device is disclosed in U.S. Pat. No. 5,628,654 issued to Lineberry, Jr., for an accessory connector adapted for insertion Into a vehicle fuse box. The connector has a pair of fuse blade receptacles for inserting additional fuse blades, such that after removing a fuse from the fuse box, the accessory connector replaces the fuse and is then located between the fuse and the fuse box.

Another device is disclosed in U.S. Pat. No. 3,744,03 issued to Dipace (3 B&D Products, Inc.), comprising a fuse block adapter, where a fuse is removed from a fuse clip and the fuse block adapter is inserted to allow for the fusing of an additional circuit.

Another device is disclosed in U.S. Pat. No. 6,457,995 B1 issued to Brooks, comprising a fuse block extender consisting of a male bus electrode and a circuit electrode positioned side by side and adapted to fit into the female electrodes of a vehicle fuse block, and of one or more accessory electrodes that connect to the bus electrode and to one or more accessories.

One disadvantage of these devices is that most are complex and expensive. Another disadvantage of these devices is that they are esthetically displacing, and thus unsuitable for customized vehicle applications. Another disadvantage of these devices is that they are limited by their principal configuration. Another disadvantage of these devices is that they are electrically unique, and require special knowledge to install and use. Another disadvantage of these devices is that they take up additional space to install. Another disadvantage of these devices is that they do not provide for use with higher load electrical appliances.

It can thus be seen that there is a need for a design of a power distribution panel that can be adapted to the various load requirements of different electrical accessories for vehicles. There is also a need for a design of a power distribution panel that can accomplish this objective while providing an esthetically enhancing architecture.

The fuse ratings and circuit descriptions are used for general Identification purposes only. The forgoing description is not intended to be instructive as to the use or safety of any particular fuse, circuit, or electrical accessory. Numerous variables, including the length and weight of the wiring are not considered here. The manufacturers recommendations for the individual electrical accessory should be consulted and followed.

BRIEF SUMMARY OF THE INVENTION

A primary advantage of the present invention is that it provides a power distribution panel kit that can be adapted to the various load requirements of different electrical accessories for vehicles. Another advantage of the present invention is that it allows for the use of less expensive fuses in higher load circuit designs. Another advantage of the present invention is that it accommodates an easily changeable configuration without any change to its esthetically enhancing architecture. Another advantage of the present invention is that it permits the addition of high load electric accessories, while eliminating the need to install additional power distribution blocks for higher fuse ratings. Another advantage of the present invention is that it provides for a broader range of circuit protection with a single fuse style.

Other advantages of the present invention will become apparent from the following descriptions, taken In connection with the accompanying drawings, wherein, by way of illustration and example, an embodiment of the present invention is disclosed.

In the preferred embodiment of the present invention, a fuse block system kit is disclosed having a nonconductive base. An electrically conductive input block is attached to the base, and a plurality of fuse clips are electrically connected to the input block. Opposite the input block, a plurality of single output blocks made of conductive material are removably attached to the base. A fuse clip is electrically connected to each single output block. Fuses are locatable in the fuse clips between the input block and the output blocks. A dual output block made of conductive material is attachable to the base in substitution of two single output blocks. In this manner, two single output blocks can be removed, and the dual output block substituted in their place. A pair of fuse clips is electrically connected to the dual output block. The resulting configuration doubles the fuse rating of the circuit without changing the size or appearance of the distribution block, and without changing the style of the fuse required.

BRIEF DESCRIPTION OF THE SEVERAL VIEWS OF THE DRAWING(S)

The drawings constitute a part of this specification and include exemplary embodiments to the invention, which may be embodied in various forms. It is to be understood that in some instances various aspects of the Invention may be shown exaggerated or enlarged to facilitate an understanding of the invention.

DETAILED DESCRIPTION OF THE INVENTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, nor to a single collection of all of the elements disclosed, but is to be accorded the widest scope consistent with the principles and features disclosed herein.

Figure 1:
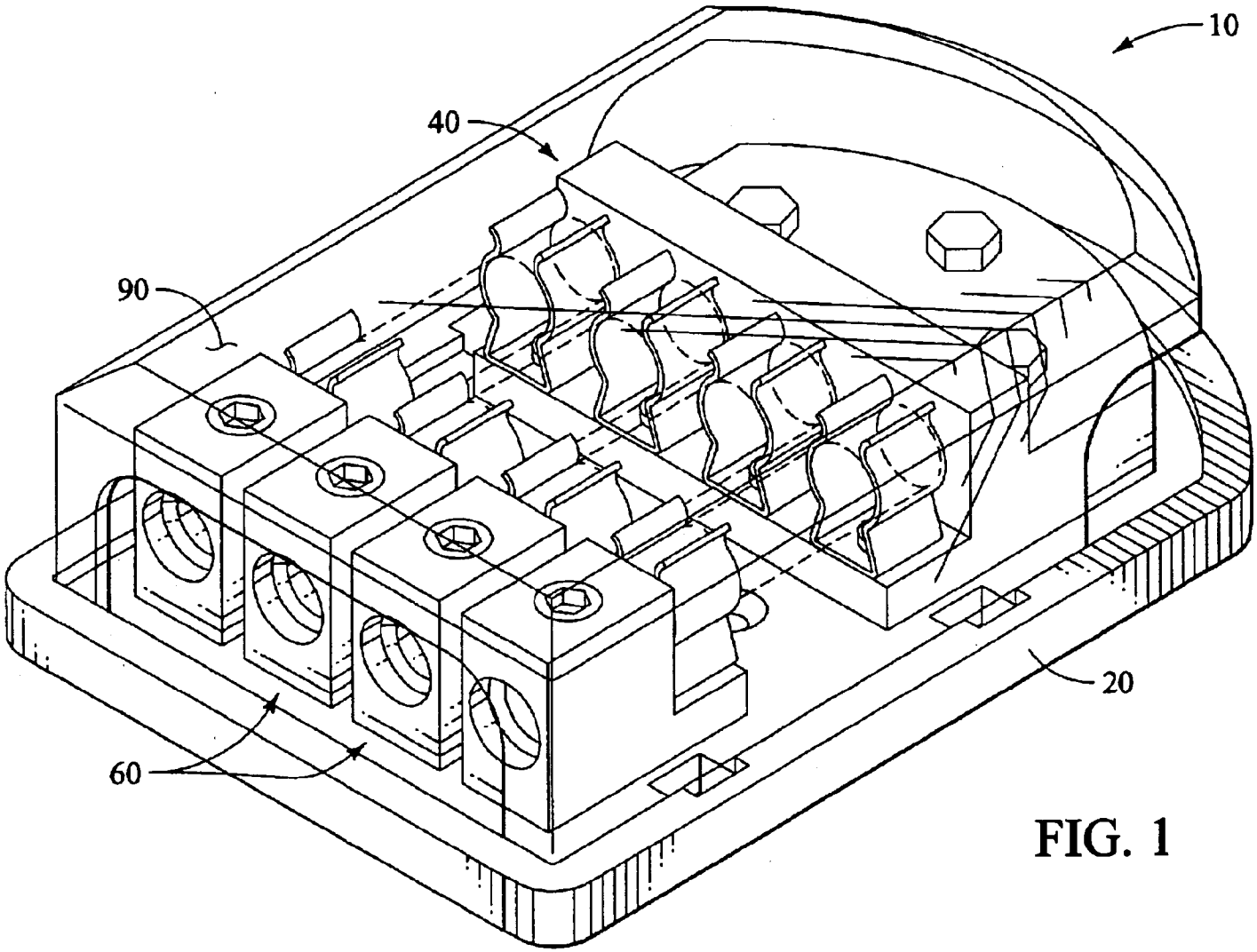
FIG. 1 is an isometric view of a preferred embodiment of the present invention, disclosing a Variably Fusable Power Distribution Block kit adaptable for use in vehicles and particularty configured to receive fuses of the AGU type.

FIG. 1 is an isometric view of a preferred embodiment of the present invention, disclosing a variably fusable power distribution block kit adaptable for use in vehicles, and particularly configured to receive fuses of the AGU type. In this figure, it is seen that power distribution block assembly 10 generally comprises a base 20, an input block assembly 40, and a plurality of single output assemblies 60. A cover 90 encloses input block assembly 40 and single output assemblies 60.

Figure 2:
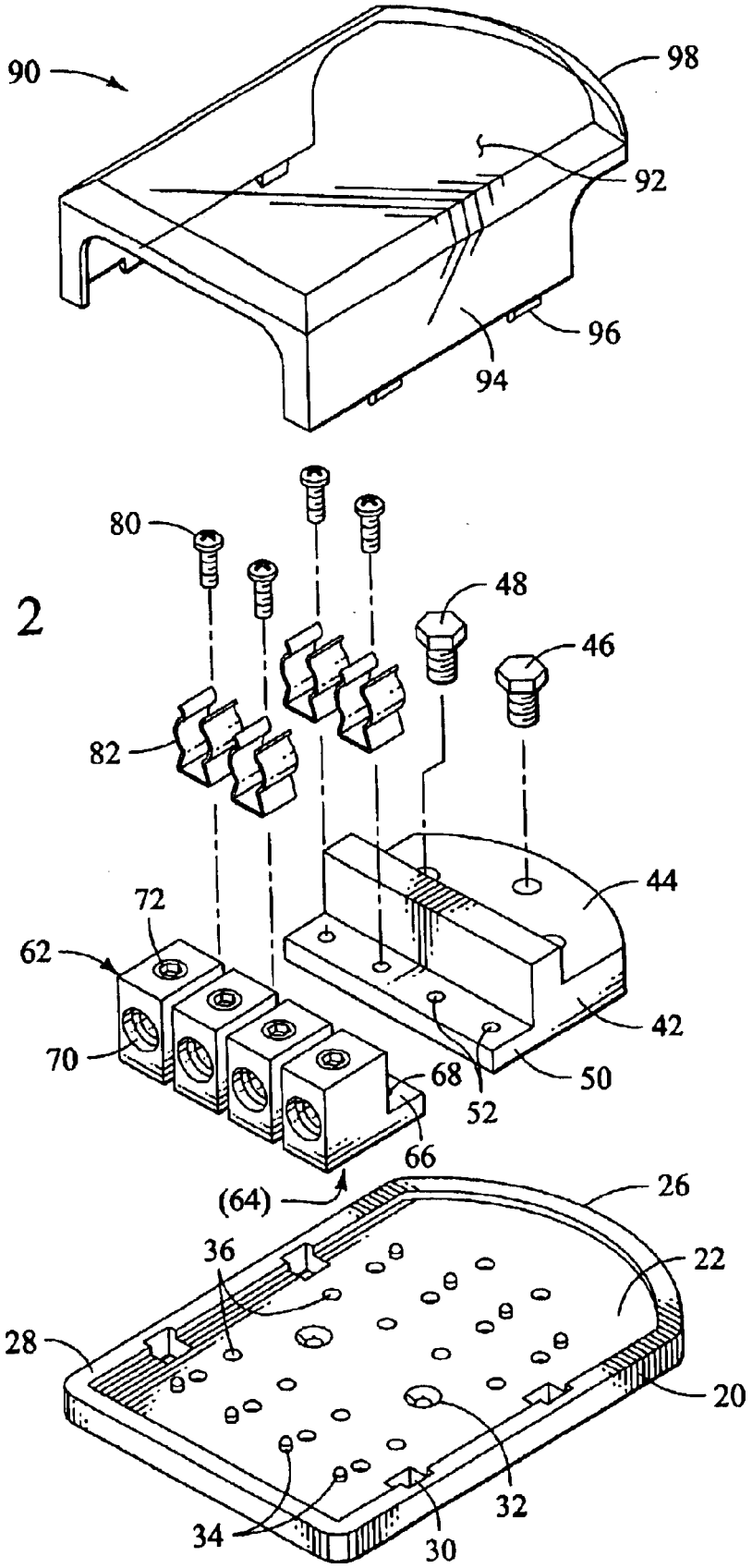
FIG. 2 is an exploded isometric view of the embodiment disclosed in FIG. 1.

FIG. 2 is an exploded view of the power distribution block assembly 10 disclosed in FIG. 1. In this view, base 20 is shown. Base 20 is preferable made of a non-conductive material, such as plastic. Base 20 has a base front 22 and an opposite base back 24 (not visible). Base 20 has a base top 26. In the preferred embodiment, base top 26 extends outwardly, such as in the convex configuration shown in FIG. 2. Also in the preferred embodiment, base 20 has a raised perimeter edge 28 extending upward from base front 22. Also in a preferred embodiment, base 20 has a plurality of slots 30 located along, or near to, raised perimeter edge 28. One or more base mounting holes 32 pass through base 20 and provide a means for attaching base 20 to the vehicle. Another feature of the preferred embodiment is the presence of locating pegs 34 formed on, and raising upward from base front 22. A plurality of block mounting holes 36 are located on base 20.

Still referring to FIG. 2, an input block 42 made of electrically conductive material is shown located on base 20. In the preferred embodiment, input block 42 has an outwardly extending top 44, such as in the convex configuration shown in FIG. 2. A terminal connector 46 is threadedly connected to input block 42. In the preferred embodiment, one or more secondary terminal connectors 48 are threadedly connected to input block 42. In a preferred embodiment, input block 42 has an input platform 50 with a plurality of threaded platform holes 52.

Still referring to FIG. 2, a plurality of single output blocks 62 made of electrically conductive material are located on base 20 opposite input block 42. Single output blocks 62 have a threaded mounting hole 64 (not visible) located on their bottom side for attachment to base 20. In a preferred embodiment, single output blocks 62 have an output platform 66. Also in a preferred embodiment, single output blocks 62 have a threaded platform hole 68 on output platform 64. An output receptacle 70 is located on the side of single output block 62 opposite platform portion 64. A terminal connector 72 is threadedly attached on top of single output block 62. Terminal connector 72 intersects output receptacle 70.

In a preferred embodiment, threaded connectors 80 attach a plurality of electrically conductive fuse clips 82 to input platform 50 through threaded platform holes 52. Likewise, a threaded connector 80 attaches a fuse clip 82 to each output platform 66 through threaded platform hole 68.

A preferred embodiment of cover 90 is further disclosed as having a face 92 and side portions 94 extending downward from face 92. Tabs 96 extend outward from side portions 94 for engagement with slots 30 of base 20. In a preferred embodiment, cover 90 has an outwardly extending top 98, such as in the convex configuration shown in FIG. 2.

Figure 3:
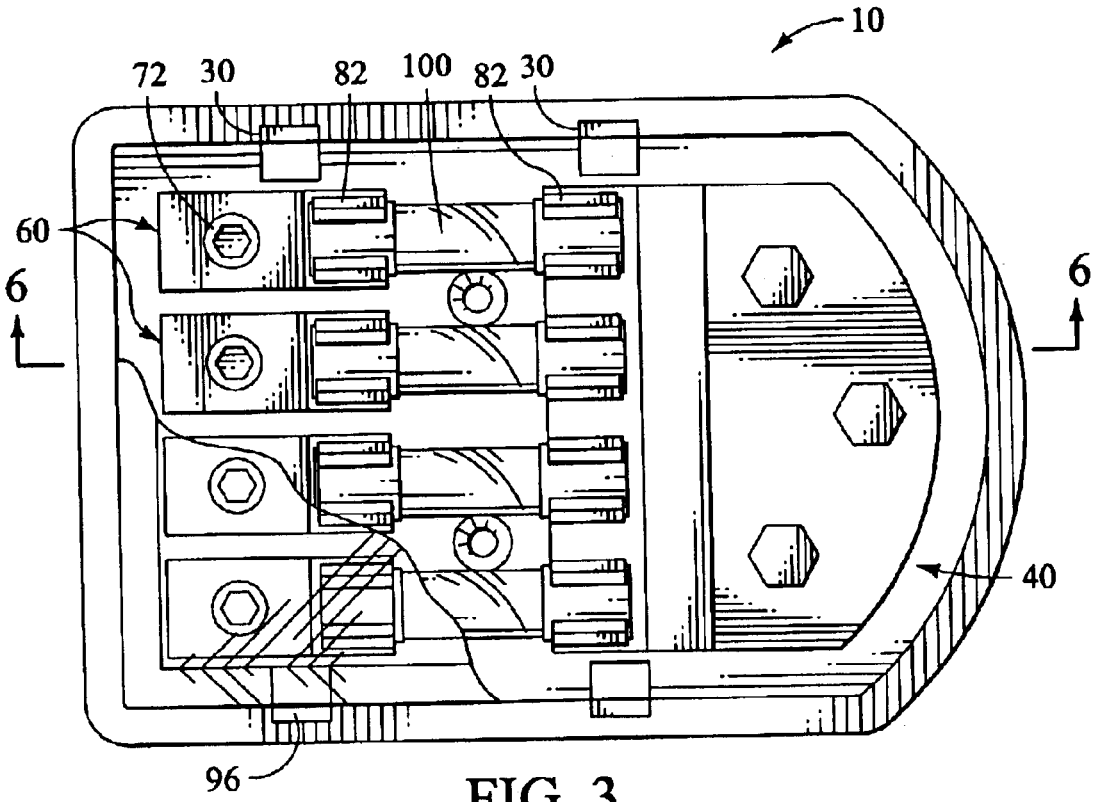
FIG. 3 is a top view of the embodiment of the invention disclosed in FIG. 1 and FIG. 2.

FIG. 3 is top view of distribution block assembly 10 in the embodiment disclosed in FIGS. 1 and 2, with a section of cover 90 shown broken away, with tabs 96 engaging slots 30. In FIG. 3, four (4) AGU fuses 100 are shown installed between fuse clips 82 on input block assembly 40 and fuse dips 82 on single output assemblies 60, establishing electrical connectivity between input block assembly 40 and single output assemblies 60.

Figure 4:
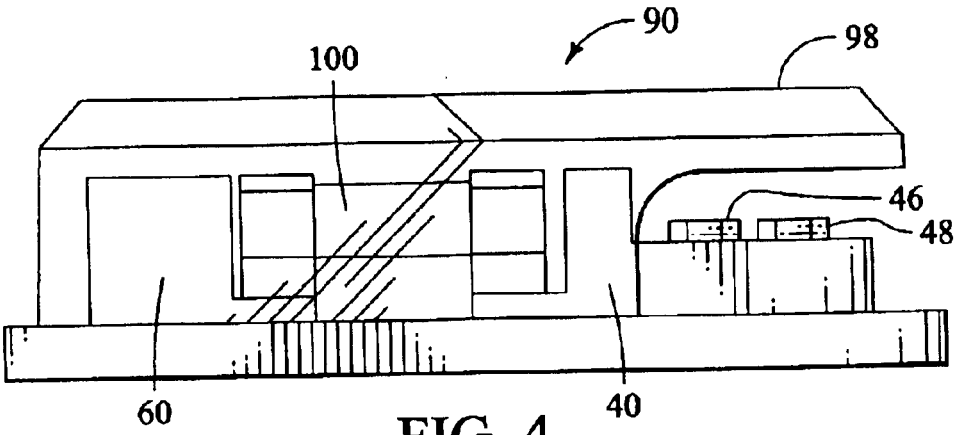
FIG. 4 is a side view of the embodiment of the invention disclosed in FIGS. 1, 2, and 3.

FIG. 4 is side view of distribution block assembly 10 in the embodiment disclosed in FIGS. 1, 2, and 3. In FIG. 4, it can be seen that the opening beneath outwardly extending top 98 of cover 90 provides access for variable positioning of an electrical connection from a power source to terminal connector 46, or for connection to secondary terminal connector 48.

Figure 5:
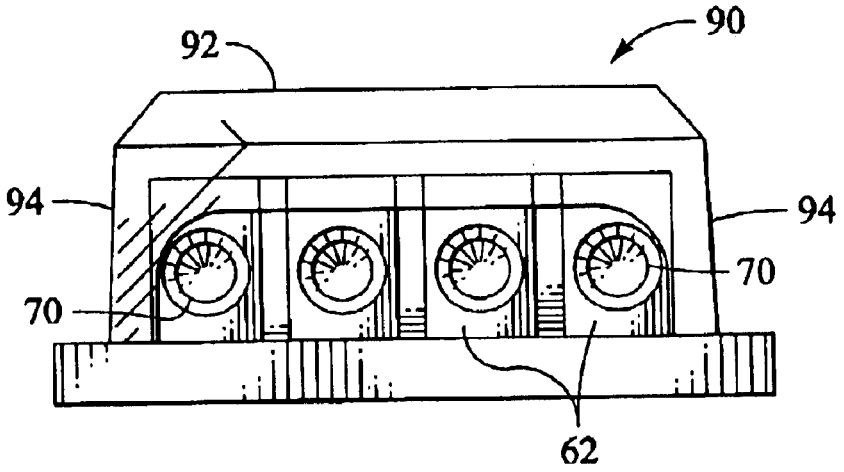
FIG. 5 is an end view of the embodiment of the invention as disclosed In FIGS. 1 through 4, showing the receptacles ends of single output blocks.

FIG. 5 is an end view of distribution block assembly 10 in the embodiment disclosed in FIGS. 1 through 4, showing output receptacles 70 of single output blocks 62. In this view, it is seen that the opening formed between face 92 and side portions 94 of cover 90 provides access for locating wiring electrically connected to each output receptacle 70 of each single output block 62, thereby defining as many as four separate fuse protected circuits in the embodiment shown.

Figure 6:
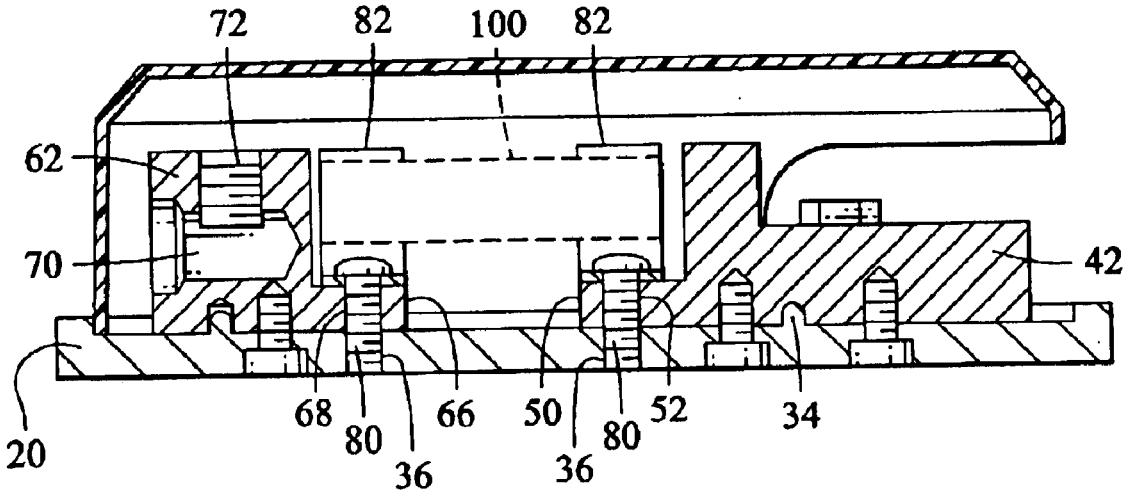
FIG. 6 is a sectional side view of the embodiment of the invention as disclosed in FIG. 4, showing the members of the base connecting to input and output blocks.

FIG. 6 is a sectional side view of distribution block assembly 10 in the embodiment disclosed in FIG. 4. In this view, it can be seen that terminal connector 72 intersects output receptacle 70 providing electrical and physical connectivity to circuit wiring installed in receptacle 70. In a preferred embodiment, threaded connector 80 attaches electrically conductive fuse clip 82 to Input platform 50 through threaded platform hole 52. In this embodiment, threaded connector 80 passes through threaded platform hole 52 so as to attach input block 42 to base 20 through threaded block mounting holes 36. Similarly, another threaded connector 80 attaches another fuse clip 82 to output platform 66 through threaded platform hole 68. Also in this embodiment, threaded connector 80 passes through threaded platform hole 68 so as to attach output block 62 to base 20 through threaded block mounting holes 36.

Still referring to FIG. 6, it can be seen that locating pegs 34 of base 20 can be used to locate and secure input block 42 on base 20. Likewise, locating pegs 34 of base 20 can be used to locate and secure output block 62 on base 20.

Figure 7:
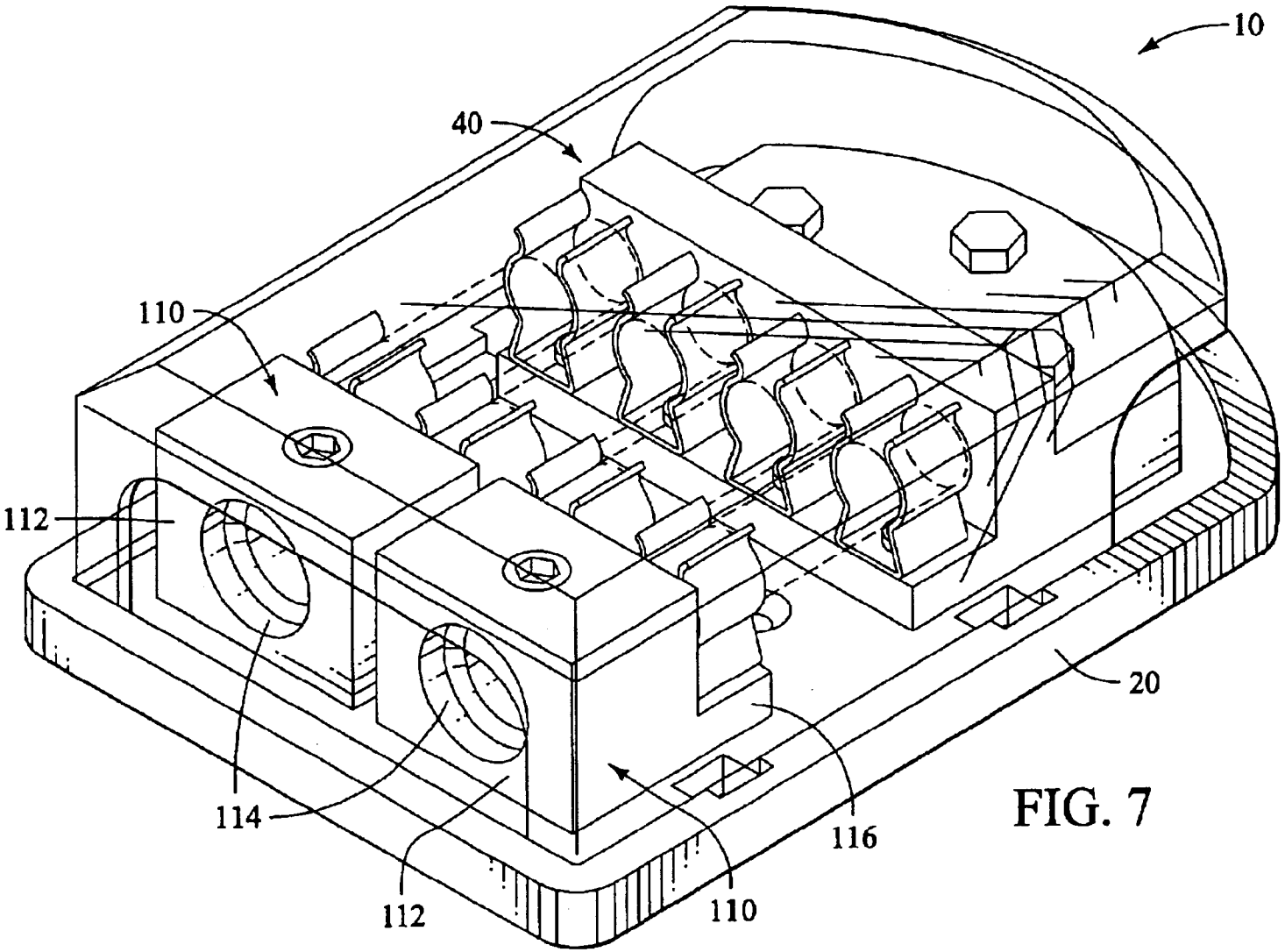
FIG. 7 is an isometric view of a preferred embodiment of the present invention, disclosing the Variably Fusable Power Distribution Block of FIG. 1, whereas dual output blocks have been substituted for the single output blocks.

FIG. 7 is an isometric view of the preferred embodiment of distribution block assembly 10. In this view of distribution block assembly 10, single output assemblies 60 have been removed and replaced with dual output assemblies 110. It is seen from FIG. 7 that the overall appearance of distribution block assembly 10 remains otherwise unchanged in appearance as compared to FIG. 1.

Each dual output assembly 110 has a dual output block 112 having a single receptacle 114 which is comparatively larger than receptacle 70 in single output block 62, and is thus capable of accommodating a larger wire size. In the preferred embodiment, fuse clip 82 is connectable to dual output block 112 with threaded connector 80. In the preferred embodiment for use with AGU fuses, dual output block 112 also has a platform portion 116 with a pair of platform holes 118 (not visible) in spaced apart alignment with base mounting holes 32. Each dual output assembly 110 is substituted into the position of two single output assemblies 60, and secured to base 20 with the same threaded connectors 80. In this configuration distribution block assembly provides two separate fuse protected circuits, each circuit having a circuit rating of approximately twice that of the individual circuits disclosed in FIG. 1.

In another preferred embodiment, not shown, distribution block assembly 10 comprises a combination of two single output assemblies 60 and one dual output assembly 110, thus providing three separate fuse protected circuits.

Figure 8:
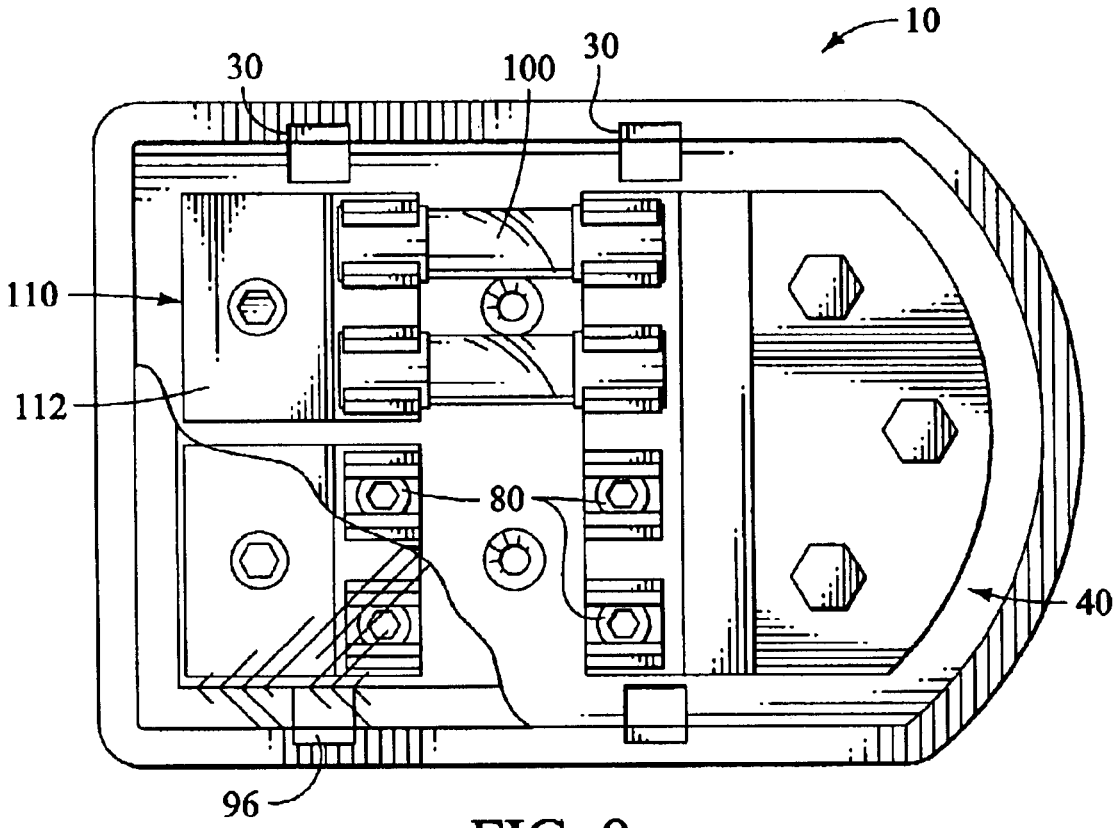
FIG. 8 is a top view of the embodiment of the invention disclosed in FIG. 7.

FIG. 8 is top view of distribution block assembly 10 in the embodiment disclosed in FIG. 7, with a section of cover 90 shown broken away, with tabs 96 engaging slots 30. In FIG. 8, two (2) AGU fuses 100 are shown installed between fuse clips 82 on input block assembly 40 and fuse clips 82 on each dual output assembly 110, establishing electrical connectivity protected by two fuses between input block assembly 40 and output block assembly 110. By dividing the current between the two fuses 100, the fuse rating of the circuit is essentially doubled, without using larger fuses.

Figure 9:
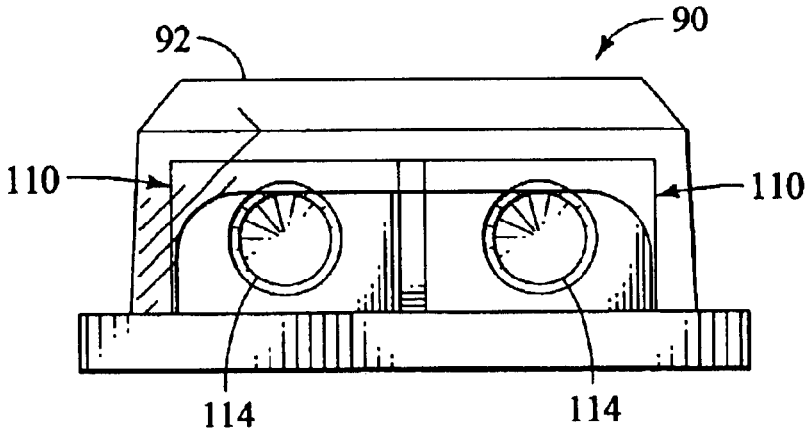
FIG. 9 is an end view of the embodiment of the invention as disclosed in FIGS. 7 and 8, showing the receptacles ends of the dual output blocks.

FIG. 9 is an end view of distribution block assembly 10 In the embodiment disclosed in FIG. 7, showing output receptacles 114 of dual output assemblies 110. In this view, it is seen that the larger opening of receptacles 114 are provided to receive the larger gage wiring associated with the higher rated circuit.

Figure 10:
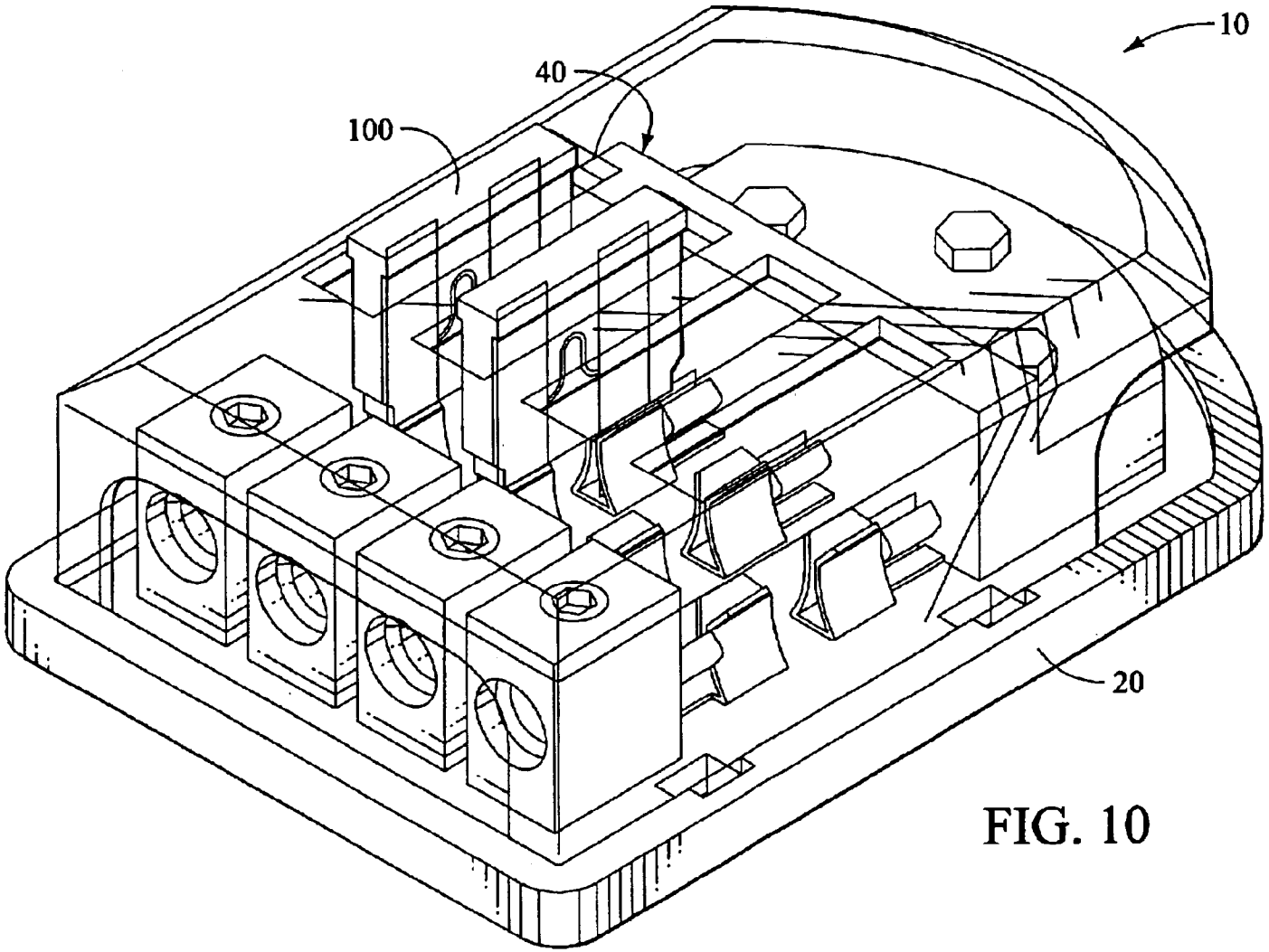
FIG. 10 is an isometric view of a preferred embodiment of the present invention, disclosing a Variably Fusable Power Distribution Block kit configured to receive fuses of the MAXI type.

FIG. 10 is an isometric view of another preferred embodiment of distribution block assembly 10. In this embodiment, power distribution block assembly 10 is configured to receive fuses 100 of the MAXI type.

OPERATION OF THE INVENTION

In the preferred embodiment of the present invention a power distribution block assembly 10 is generally comprised of a base 20, an input block assembly 40, and a plurality of single output assemblies 60. A cover 90 encloses input block assembly 40 and single output assemblies 60. Fuses 100 are removably installed between fuse clips 82 on the input block assembly 40 and fuse clips 82 on single output assemblies 60. Single output assemblies 60 are removably attached to non-conductive base 20 by threaded connectors 80. In the preferred embodiment, a threaded connector 80 connects a fuse clip 82 to a single output block 62 through a threaded platform hole 68. In the more preferred embodiment, threaded connector 80 also connects single output block 62 to base 20 through one of the threaded block mounting holes 36.

When the vehicle owner elects to connect an electrical accessory that requires more electrical power to operate than can be provided by the largest available fuse 100 that fits in power distribution block assembly 10, the operator can remove two single input block assemblies 40 that are adjacently located, and replace them with one dual output assembly 110. In the preferred embodiment, the same fuse dips 82, and threaded connectors that are used for single output assembly 40 can be used to assemble and attach dual output assembly 110. Theoretically, even fuses 100 can be used, if properly sized to accommodate the current rating requirement of the new electrical accessory.

Figure 11:
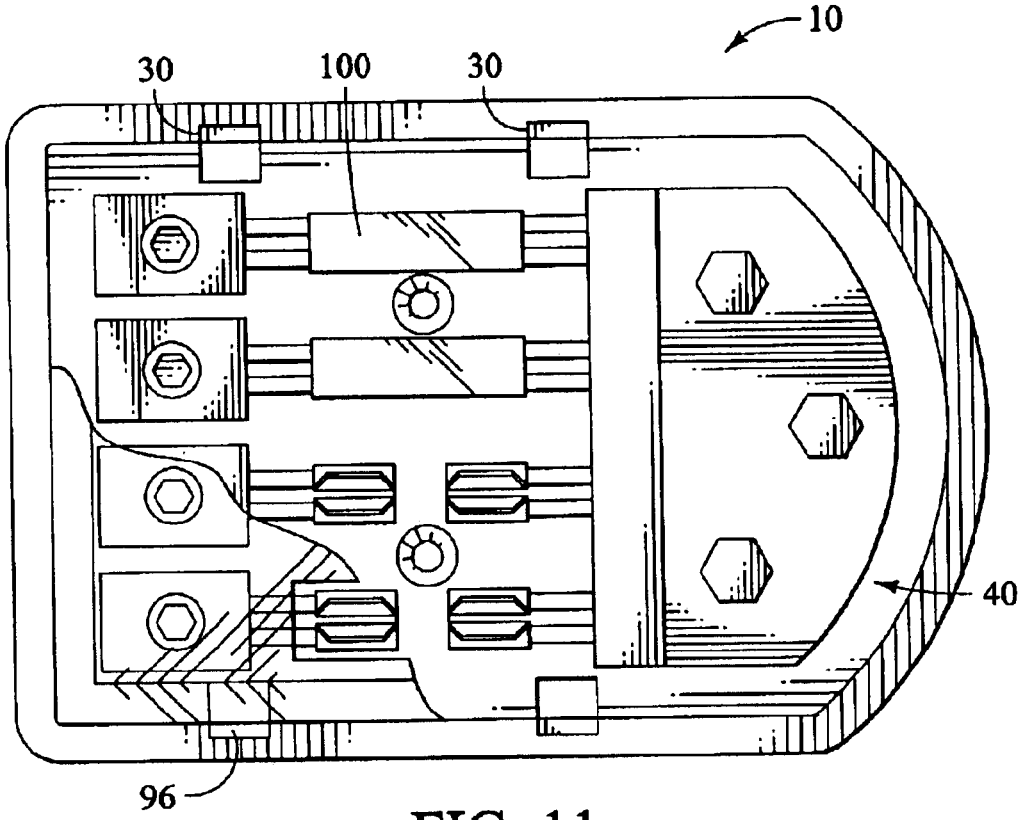
FIG. 11 is a top view of the embodiment of the invention disclosed in FIG. 10.

FIG. 11 is a top view of the basic embodiment of the present disclosure showing a schematic for a circuit in which power from a power source 120 is directed through a circuit 122, which is connected at a wire end to terminal connector 46 on input block assembly 40. In this configuration, four single output assemblies 60 define four separate circuits through which electrical power from power source 120 is distributed. Each of circuits 124, 126, 128, and 130 have a wire end located in a receptacle 70 of a single output block 60. The current capacity of each circuit is defined by their respective fuse 100 rating for the circuit For example, the rating of circuit 124 is the amp rating of fuse 100*a*, the rating of circuit 126 is the amp rating of fuse 100*b*, the rating of circuit 128 is the amp rating of fuse 100*c*, and rating of circuit 130 is the amp rating of fuse 100*d*.

Figure 12:
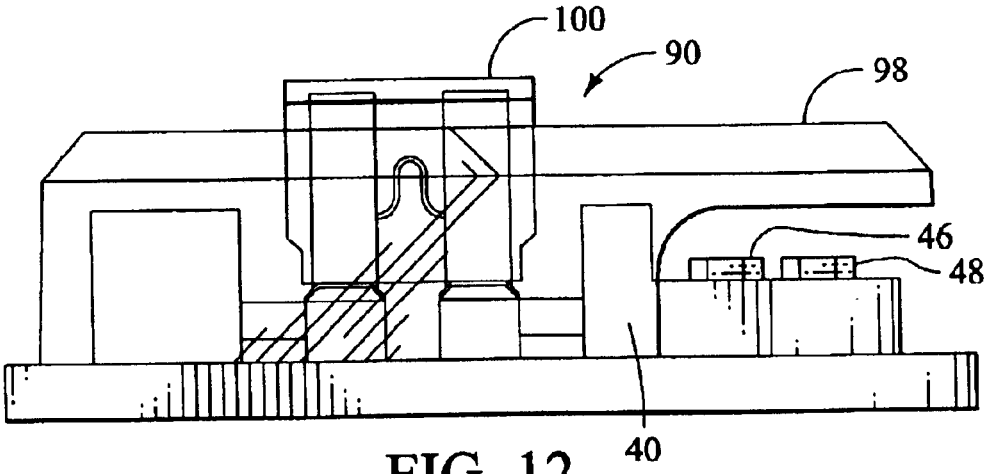
FIG. 12 is a side view of the embodiment of the invention disclosed in FIGS. 10 and 11.
Figure 13:
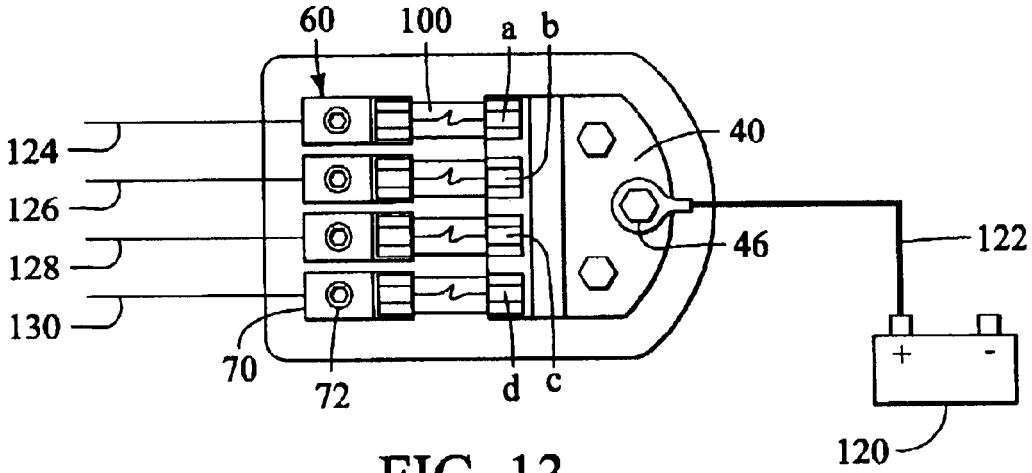
FIG. 13 is a top view of the basic embodiment of the present disclosure as disclosed in FIG. 1, showing a schematic of a circuit in which power from a power source is directed through an input connector on the input block, and being distributed to four fuses attached to single output blocks, defining four separate circuits.
Figure 14:
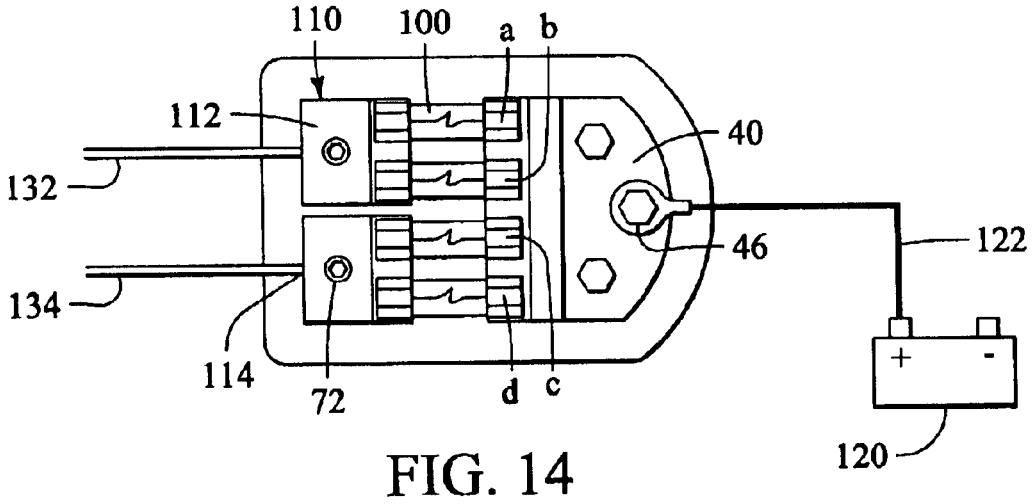
FIG. 14 is a top view of the basic embodiment of the present disclosure as disclosed in FIG. 7, showing a schematic of a circuit in which power from a power source is directed through an input connector on the input block, and being distributed to four fuses attached to dual output blocks, defining two separate circuits.

FIG. 12 is a top view of the embodiment disclosed in FIG. 11, whereas the vehicle owner has removed all four single output assemblies 60, and replaced them on the same base with two dual output assemblies 110. In this configuration, dual output assemblies 110 define two separate circuits through which electrical power from power source 120 is distributed. Each of circuits 132 and 134 have a wire end located in a receptacle 70 of a single output block 60. The current capacity of each circuit is defined as the combined rating of the respective fuses 100 connected to dual output assembly 110. The fuses attached to a dual block assembly should have the same amp rating. Thus, the rating of circuit 132 is the sum of the amp rating of fuses 100*a* and 100*b*, and the rating of circuit 134 is the sum of the amp rating of fuses 100*c* and 100*d*.

While this invention has been described in connection with a preferred embodiment it is not intended to limit the scope of the invention to the particular form set forth, but on the contrary, it is intended to cover such altematives, modifications, and equivalents as may be included within the spirit and scope of the invention as defined by the appended claims.

The result from the use of the disclosed invention is that the vehicle owner can configure a circuit for amperage rating higher than the highest fuse rating otherwise available for a given fuse style. In addition, the present invention permits various such configurations, including the use of a dual output assembly in the center, or on either side of the power distribution block 10. It is also seen from the foregoing that the present invention permits the user to avoid the cost, expense and trouble of purchasing additional power distribution blocks in many applications. It is also seen that the present invention preserves the aesthetic appeal of the device, even when reconfigured. It is also seen that the present invention allows for use of many of the same component parts in either configuration.

It will be appreciated by one of ordinary skill in the art that other configurations of the output blocks are possible based on this disclosure. For example, a triple output block assembly can be provided in the manner disclosed for a dual output assembly, and thus substitute in the place of three single output block assemblies. It is also recognized that numerous methods for connection and attachment of the essential elements are possible, but that the choice of such connection and attachment does not depart from the spirit and scope of the present invention.

We claim:

1. A variably fusable power distribution block kit, comprising:

a base;

an input block attached to the base;

a plurality of single output assemblies removably attached to the base; and, a dual output assembly removably attachable to the base in substitution of two adjacent single output assemblies.

2. A variably fusable power distribution block kit, comprising:

a base;

an input block attached to the base;

a plurality of fuse dips connected to the input block;

a plurality of single output blocks removably attached to the base;

a fuse clip connected to each single output block;

a dual output block removably attachable to the base in substitution of two adjacent single output blocks; and, a pair of fuse clips connected to the dual output block.

3. The variably fusable power distribution block kit of claim 2, further comprising;

each fuse clip being removably connected to each single output block; and, whereas once removed, each fuse clip is connectable to the dual output block.

4. The variably fusable power distribution block kit of claim 3, further comprising;

each fuse clip removably connected to each single output block by a threaded connector, and, whereas the threaded connected further attaches the single output block to the base.

5. A dual output assertibly for use in a fuse block kit, comprising:

a dual output block having mounting holes for attachment to a base having two removably attached single output blocks;

a pair of fuse clips connected to the dual output block; and, whereas the dual output block is attachable to the base in substitution of the two single output blocks.

* * * * *